US008274203B2

(12) United States Patent
Ma et al.

(10) Patent No.: US 8,274,203 B2
(45) Date of Patent: Sep. 25, 2012

(54) ELECTRODE MATERIAL FOR A SPARK PLUG

(75) Inventors: Shuwei Ma, Ann Arbor, MI (US); James D. Lykowski, Temperance, MI (US)

(73) Assignee: Federal-Mogul Ignition Company, Southfield, MI (US)

( * ) Notice: Subject to any disclaimer, the term of this patent is extended or adjusted under 35 U.S.C. 154(b) by 43 days.

(21) Appl. No.: 12/954,011

(22) Filed: Nov. 24, 2010

(65) Prior Publication Data

US 2011/0127900 A1 Jun. 2, 2011

Related U.S. Application Data

(60) Provisional application No. 61/265,483, filed on Dec. 1, 2009.

(51) Int. Cl.
*H01T 13/20* (2006.01)

(52) U.S. Cl. ..... 313/141; 313/118; 313/136; 313/138; 313/140; 123/169 EL

(58) Field of Classification Search ..... 313/141
See application file for complete search history.

(56) References Cited

U.S. PATENT DOCUMENTS

| | | | | |
|---|---|---|---|---|
| 3,868,530 | A * | 2/1975 | Eaton et al. | 313/141 |
| 4,881,913 | A * | 11/1989 | Mann | 445/7 |
| 5,866,973 | A | 2/1999 | Kagawa et al. | |
| 6,071,163 | A | 6/2000 | Chang et al. | |
| 6,166,480 | A * | 12/2000 | Ishida et al. | 313/141 |
| 6,579,738 | B2 * | 6/2003 | Farrar et al. | 438/33 |
| 6,885,136 | B2 * | 4/2005 | Orjela et al. | 313/141 |
| 7,187,110 | B2 * | 3/2007 | Suzuki | 313/141 |
| 2004/0183418 | A1 * | 9/2004 | Orjela et al. | 313/141 |
| 2006/0158082 | A1 | 7/2006 | Menken et al. | |
| 2007/0236123 | A1 * | 10/2007 | Lykowski et al. | 313/141 |

FOREIGN PATENT DOCUMENTS

JP 2004235040 A * 8/2004

OTHER PUBLICATIONS

Machine English translation of JP2004235040 to Nunome et al.*
International Search Report for PCT/US2010/058501, Aug. 31, 2011, 3 pages.

* cited by examiner

*Primary Examiner* — Sikha Roy
(74) *Attorney, Agent, or Firm* — Reising Ethington P.C.

(57) ABSTRACT

A spark plug electrode material that may be used in spark plugs and other ignition devices including industrial plugs, aviation igniters, glow plugs, or any other device that is used to ignite an air/fuel mixture in an engine. According to an exemplary embodiment, the electrode material includes a refractory metal (for example, tungsten (W), molybdenum (Mo), rhenium (Re), ruthenium (Ru) and/or chromium (Cr)) and a precious metal (for example, rhodium (Rh), platinum (Pt), palladium (Pd) and/or iridium (Ir)), where the refractory metal is present in an amount that is greater than that of the precious metal. This includes, but is certainly not limited to, electrode materials including tungsten-based alloys such as W—Rh and ruthenium-based alloys such as Ru—Rh. Other combinations and embodiments are also possible.

18 Claims, 1 Drawing Sheet

ELECTRODE MATERIAL FOR A SPARK PLUG

REFERENCE TO RELATED APPLICATIONS

This application claims the benefit of U.S. Provisional Ser. No. 61/265,483 filed on Dec. 1, 2009, the entire contents of which are incorporated herein.

TECHNICAL FIELD

This invention generally relates to spark plugs and other ignition devices for internal combustion engines and, in particular, to electrode materials for spark plugs.

BACKGROUND

Spark plugs can be used to initiate combustion in internal combustion engines. Spark plugs typically ignite a gas, such as an air/fuel mixture, in an engine cylinder or combustion chamber by producing a spark across a spark gap defined between two or more electrodes. Ignition of the gas by the spark causes a combustion reaction in the engine cylinder that is responsible for the power stroke of the engine. The high temperatures, high electrical voltages, rapid repetition of combustion reactions, and the presence of corrosive materials in the combustion gases can create a harsh environment in which the spark plug must function. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metals used with an electrode by using such materials only at a firing tip or spark portion of the electrodes where a spark jumps across a spark gap.

SUMMARY

According to one embodiment, there is provided a spark plug that comprises a metallic shell, an insulator, a center electrode and a ground electrode. The center electrode, the ground electrode or both includes an electrode material having a refractory metal and a precious metal, and the refractory metal is the single largest constituent of the electrode material on a wt % basis.

According to another embodiment, there is provided a spark plug electrode that comprises an electrode material having a refractory metal and a precious metal. The refractory metal has a melting temperature that is greater than that of the precious metal, and the refractory metal is the single largest constituent of the electrode material on a wt % basis.

According to another embodiment, there is provided a spark plug electrode that comprises an electrode material having tungsten (W), rhodium (Rh) and at least one other constituent. Tungsten (W) is the single largest constituent of the electrode material.

BRIEF DESCRIPTION OF THE DRAWINGS

Preferred exemplary embodiments of the invention will hereinafter be described in conjunction with the appended drawings, wherein like designations denote like elements, and wherein.

DETAILED DESCRIPTION OF THE PREFERRED EMBODIMENTS

Figure 1:
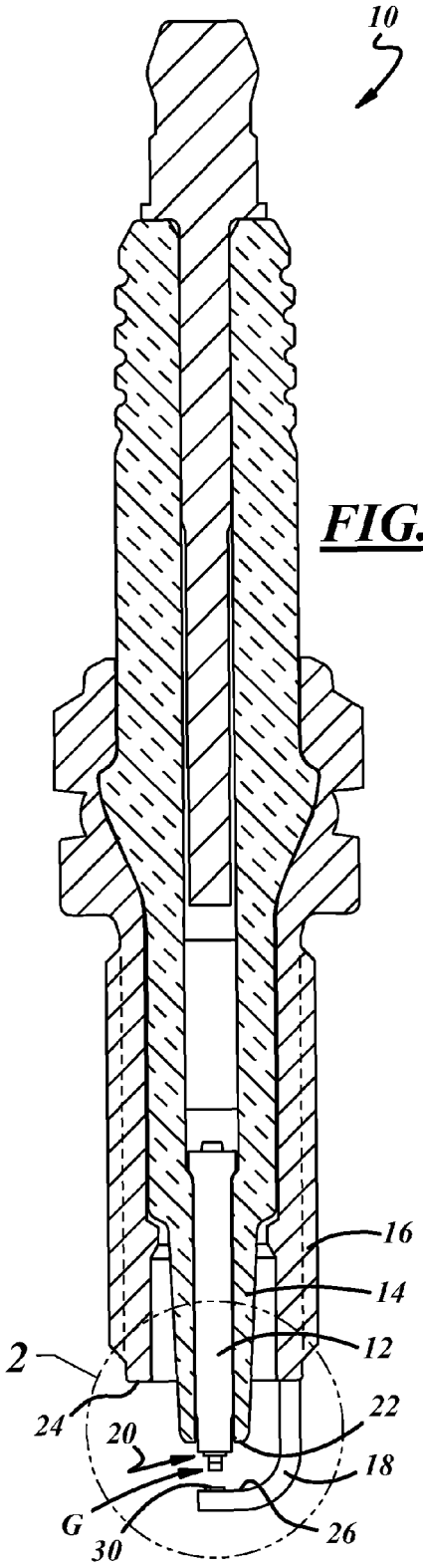
FIG. 1 is a cross-sectional view of an exemplary spark plug that may use the electrode material described below.

The electrode material described herein may be used in spark plugs and other ignition devices including industrial plugs, aviation igniters, glow plugs, or any other device that is used to ignite an air/fuel mixture in an engine. This includes, but is certainly not limited to, the exemplary spark plugs that are shown in the drawings and are described below. Furthermore, it should be appreciated that the electrode material may be used in a firing tip that is attached to a center and/or ground electrode or it may be used in the actual center and/or ground electrode itself, to cite several possibilities. Other embodiments and applications of the electrode material are also possible.

Figure 2:
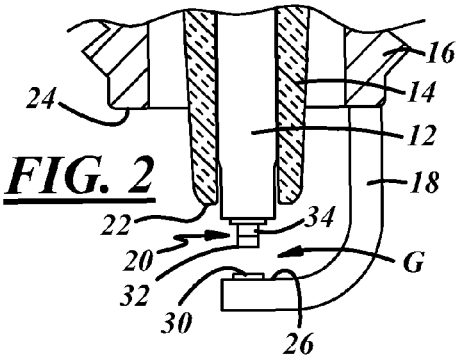
FIG. 2 is an enlarged view of the firing end of the exemplary spark plug from FIG. 1, wherein a center electrode has a firing tip in the form of a multi-piece rivet and a ground electrode has a firing tip in the form of a flat pad.

Referring to FIGS. 1 and 2, there is shown an exemplary spark plug 10 that includes a center electrode 12, an insulator 14, a metallic shell 16, and a ground electrode 18. The center electrode or base electrode member 12 is disposed within an axial bore of the insulator 14 and includes a firing tip 20 that protrudes beyond a free end 22 of the insulator 14. The firing tip 20 is a multi-piece rivet that includes a first component 32 made from an erosion- and/or corrosion-resistant material, like the electrode material described below, and a second component 34 made from an intermediary material like a high-chromium nickel alloy. In this particular embodiment, the first component 32 has a cylindrical shape and the second component 34 has a stepped shape that includes a diametrically-enlarged head section and a diametrically-reduced stem section. The first and second components may be attached to one another via a laser weld, a resistance weld, or some other suitable welded or non-welded joint. Insulator 14 is disposed within an axial bore of the metallic shell 16 and is constructed from a material, such as a ceramic material, that is sufficient to electrically insulate the center electrode 12 from the metallic shell 16. The free end 22 of the insulator 14 may protrude beyond a free end 24 of the metallic shell 16, as shown, or it may be retracted within the metallic shell 16. The ground electrode or base electrode member 18 may be constructed according to the conventional L-shape configuration shown in the drawings or according to some other arrangement, and is attached to the free end 24 of the metallic shell 16. According to this particular embodiment, the ground electrode 18 includes a side surface 26 that opposes the firing tip 20 of the center electrode and has a firing tip 30 attached thereto. The firing tip 30 is in the form of a flat pad and defines a spark gap G with the center electrode firing tip 20 such that they provide sparking surfaces for the emission and reception of electrons across the spark gap.

Figure 3:
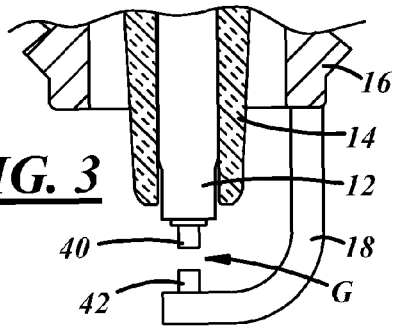
FIG. 3 is an enlarged view of a firing end of another exemplary spark plug that may use the electrode material described below, wherein the center electrode has a firing tip in the form of a single-piece rivet and the ground electrode has a firing tip in the form of a cylindrical tip.
Figure 4:
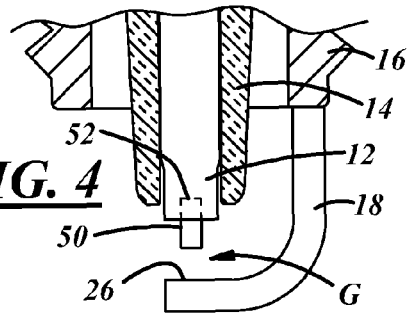
FIG. 4 is an enlarged view of a firing end of another exemplary spark plug that may use the electrode material described below, wherein the center electrode has a firing tip in the form of a cylindrical tip located in a recess and the ground electrode has no firing tip.
Figure 5:
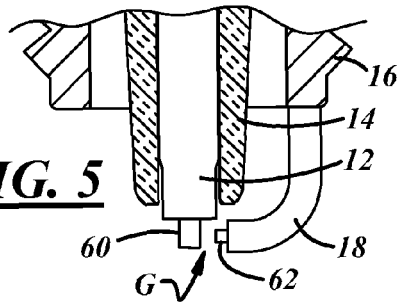
FIG. 5 is an enlarged view of a firing end of another exemplary spark plug that may use the electrode material described below, wherein the center electrode has a firing tip in the form of a cylindrical tip and the ground electrode has a firing tip in the form of a cylindrical tip that extends from an axial end of the ground electrode.

In this particular embodiment, the first component 32 of the center electrode firing tip 20 and/or the ground electrode firing tip 30 may be made from the electrode material described herein; however, these are not the only applications for the electrode material. For instance, as shown in FIG. 3, the exemplary center electrode firing tip 40 and/or the ground electrode firing tip 42 may also be made from the electrode material. In this case, the center electrode firing tip 40 is a single-piece rivet and the ground electrode firing tip 42 is a cylindrical tip that extends away from a side surface 26 of the ground electrode by a considerable distance. The electrode material may also be used to form the exemplary center electrode firing tip 50 and/or the ground electrode 18 that is shown in FIG. 4. In this example, the center electrode firing tip 50 is a cylindrical component that is located in a recess or blind hole 52, which is formed in the axial end of the center electrode 12. The spark gap G is formed between a sparking surface of the center electrode firing tip 50 and a side surface 26 of the ground electrode 18, which also acts as a sparking surface. FIG. 5 shows yet another possible application for the electrode material, where a cylindrical firing tip 60 is attached to an axial end of the center electrode 12 and a cylindrical firing tip 62 is attached to an axial end of the ground electrode 18. The ground electrode firing tip 62 forms a spark gap G with a side surface of the center electrode firing tip 60, and is thus a somewhat different firing end configuration than the other exemplary spark plugs shown in the drawings.

Again, it should be appreciated that the non-limiting spark plug embodiments described above are only examples of some of the potential uses for the electrode material, as it may be used or employed in any firing tip, electrode, spark surface or other firing end component that is used in the ignition of an air/fuel mixture in an engine. For instance, the following components may be formed from the electrode material: center and/or ground electrodes; center and/or ground electrode firing tips that are in the shape of rivets, cylinders, bars, columns, wires, balls, mounds, cones, flat pads, disks, rings, sleeves, etc.; center and/or ground electrode firing tips that are attached directly to an electrode or indirectly to an electrode via one or more intermediate, intervening or stress-releasing layers; center and/or ground electrode firing tips that are located within a recess of an electrode, embedded into a surface of an electrode, or are located on an outside of an electrode such as a sleeve or other annular component; or spark plugs having multiple ground electrodes, multiple spark gaps or semi-creeping type spark gaps. These are but a few examples of the possible applications of the electrode material, others exist as well. As used herein, the term "electrode"—whether pertaining to a center electrode, a ground electrode, a spark plug electrode, etc.—may include a base electrode member by itself, a firing tip by itself, or a combination of a base electrode member and one or more firing tips attached thereto, to cite several possibilities.

According to an exemplary embodiment, the electrode material includes a refractory metal and a precious metal, where the refractory metal has a melting temperature that is greater than that of the precious metal, and the refractory metal is present in the electrode material in an amount that is greater than that of the precious metal. Because there are some discrepancies between different periodic tables, a periodic table published by the International Union of Pure and Applied Chemistry (IUPAC) is provided in Addendum A (hereafter the "attached periodic table") that is to be used with the present application. A "refractory metal," as used herein, broadly includes all transition metals that are selected from groups 5-8 of the attached periodic table and have a melting temperature in excess of about 1,700° C. The refractory metal may provide the electrode material with any number of desirable attributes, including a high melting temperature and correspondingly high resistance to spark erosion. Some non-limiting examples of refractory metals that are suitable for use in the electrode material include tungsten (W), molybdenum (Mo), rhenium (Re), ruthenium (Ru) and chromium (Cr). In some embodiments, a refractory metal is the single greatest or largest constituent of the electrode material even if it is less than 50 wt % of the overall electrode material; in other embodiments, a refractory metal is the single greatest or largest constituent of the electrode material and is present in an amount greater than or equal to 50 wt % and less than or equal to 99 wt %.

A "precious metal," as used herein, broadly includes all platinum group metals that are selected from group 9 or 10 of the attached periodic table. The precious metal may provide the electrode material with a variety of desirable attributes, including a high resistance to oxidation and/or corrosion. Some non-limiting examples of precious metals that are suitable for use in the electrode material include rhodium (Rh), platinum (Pt), palladium (Pd), and iridium (Ir). In an exemplary embodiment, a precious metal is the second greatest or largest constituent of the electrode material and is present in an amount greater than or equal to 1 wt % and less than or equal to 50 wt %. It is possible for the electrode material to include one or more precious metals and, in one embodiment, the electrode material includes first and second precious metals where each of the first and second precious metals is present in an amount greater than or equal to 1 wt % and less than or equal to 50 wt %, and where the amount of the first and second precious metals together is still less than the amount of the refractory metal in the electrode material.

The refractory metal and the precious metal may cooperate in the electrode material such that the electrode has a high wear resistance, including significant resistance to spark erosion, chemical corrosion, and/or oxidation, for example. The relatively high melting points of the refractory metals may provide the electrode material with a high resistance to spark erosion or wear, while the precious metals may provide the electrode material with a high resistance to chemical corrosion and/or oxidation. A table listing some exemplary refractory and precious metals, as well as their corresponding melting temperatures, is provided below (TABLE I). It is not necessary for the precious metal to prevent oxides from forming altogether, although they can. In some instances, the precious metal may improve the wear resistance of the electrode material by forming oxides such as rhodium oxide ($Rh_2O_3$), which can be more stable than oxides of refractory metals like tungsten oxide. During the oxidation of an electrode material that includes one or more refractory metals and one or more precious metals, the refractory metal(s) can favorably volatize or evaporate from the surface of the electrode material while the precious metal(s) may form stable oxides on the surface. The result may be a protective surface layer comprising precious metal oxides with a sublayer that is rich in precious metal(s). The stable protective surface layer may act to prevent or retard further oxidation of the electrode material and may be beneficial, but it is certainly not necessary. In one embodiment, the stable protective surface layer has a thickness of about 1 to 12 microns (μm).

TABLE I

| Melting Temperatures of Exemplary Metals (as published by the American Chemical Society) | |
|---|---|
| | Melting Temperature (° C.) |
| Refractory Metals | |
| Tungsten (W) | 3422 |
| Rhenium (Re) | 3186 |
| Molybdenum (Mo) | 2623 |
| Ruthenium (Ru) | 2334 |
| Chromium (Cr) | 1907 |
| Precious Metals | |
| Iridium (Ir) | 2446 |
| Rhodium (Rh) | 1964 |
| Platinum (Pt) | 1768 |
| Palladium (Pd) | 1555 |

Until now, the use of tungsten in electrode materials has been limited due to its relatively low resistance to corrosion and/or oxidation. By alloying tungsten with one or more precious metals as described herein, a tungsten-based material having sufficient oxidation resistance for use in spark plug electrodes may be created while limiting the need for more costly precious metal(s). For example, the electrode material can include up to about 99 wt % of tungsten (W) with the remainder including one or more precious metals, as well as other materials. Of course, other refractory metals can be used in place of tungsten.

In one embodiment, the electrode material is a tungsten-based material that includes tungsten (W) and at least one additional constituent, where tungsten (W) is the single largest constituent of the electrode material. Examples of suitable electrode material compositions that fall within this exemplary embodiment include those compositions having tungsten (W) plus a precious metal from the group of platinum (Pt), iridium (Ir), rhodium (Rh) and/or palladium (Pd), such as W—Pt, W—Ir, W—Rh, W—Pd, etc. Such compositions may include the following non-limiting examples: 51W49Pt, 51W49Ir, 51W49Rh, 80W20Pt, 80W20Ir, 80W20Rh, 90W10Pt, 90W10Ir, and 90W10Rh; other examples are certainly possible.

In another embodiment, the electrode material is a tungsten-based material that includes the following constituents: tungsten in an amount greater than or equal to 50 wt % and less than or equal to 99 wt %, a first precious metal in an amount greater than or equal to 1 wt % and less than or equal to 50 wt %, and a second precious metal in an amount greater than or equal to 1 wt % and less than or equal to 50 wt %, wherein the amount of the first and second precious metals together is less than or equal to the amount of tungsten (W). Examples of suitable electrode material compositions that fall within this exemplary embodiment include those compositions having tungsten (W) and some combination of platinum (Pt), iridium (Ir), rhodium (Rh) and/or palladium (Pd), such as W—Pt—Rh, W—Ir—Rh, W—Pt—Ir, W—Rh—Pd, etc. Such compositions may include the following non-limiting examples: 50W40Pt10Rh, 50W40Ir10Rh, 50W40Pt10Ir, 80W10Pt10Rh, 80W10Ir10Rh, 80W15Pt5Ir, 90W5Pt5Rh, 90W5Ir5Rh, and 90W8Pt2Ir; other examples are certainly possible. In some embodiments rhodium (Rh) is the preferred precious metal and is present in a higher wt % than the other precious metal constituents. The exemplary tungsten-based materials just described may be used in a firing tip that is directly attached to an anode (e.g., a ground electrode), they may be used in the actual anode itself, or they may be used in some other application.

In another embodiment, the electrode material is a ruthenium-based material that includes ruthenium (Ru) and at least one additional constituent, where ruthenium (Ru) is the single largest constituent of the electrode material. Examples of suitable electrode material compositions that fall within this exemplary embodiment include those compositions having ruthenium (Ru) plus a precious metal from the group of platinum (Pt), iridium (Ir), rhodium (Rh) and/or palladium (Pd), such as Ru—Pt, Ru—Ir, Ru—Rh, Ru—Pd, etc. Such compositions may include the following non-limiting examples: 51Ru49Pt, 51Ru49Ir, 51Ru49Rh, 51Ru49Pd, 80Ru20Pt, 80Ru20Ir, 80Ru20Rh, 80Ru20Pd, 90Ru10Pt, 90Ru10Ir, 90Ru10Rh, and 90Ru10Pd; other examples are certainly possible.

In another embodiment, the electrode material is a ruthenium-based material that includes the following constituents: ruthenium in an amount greater than or equal to 50 wt % and less than or equal to 99 wt %, a first precious metal in an amount greater than or equal to 1 wt % and less than or equal to 50 wt %, and a second precious metal in an amount greater than or equal to 1 wt % and less than or equal to 50 wt %, wherein the amount of the first and second precious metals together is less than or equal to the amount of ruthenium (Ru). Examples of suitable electrode material compositions that fall within this exemplary embodiment include those compositions having ruthenium (Ru) and some combination of platinum (Pt), iridium (Ir), rhodium (Rh) and/or palladium (Pd), such as Ru—Pt—Rh, Ru—Ir—Rh, Ru—Pt—Ir, Ru—Rh—Pd, etc. Such compositions may include the following non-limiting examples: 50Ru30Pt20Rh, 50Ru30Ir20Rh, 50Ru30Pt20Ir, 50Ru40Pt10Rh, 50Ru40Ir10Rh, 50Ru40Pt10Ir, 80Ru10Pt10Rh, 80Ru10Ir10Rh, 80Ru15Pt5Ir, 90Ru5Pt5Rh, 90Ru5Ir5Rh, and 90Ru8Pt2Ir; other examples are certainly possible. In some embodiments, rhodium (Rh) is the preferred precious metal and is present in a higher wt % than the other precious metal constituents. The exemplary ruthenium-based materials just described may be used in a firing tip that is directly attached to a cathode (e.g., a center electrode) and/or an anode (e.g., a ground electrode), they may be used in a firing tip that is indirectly attached to a cathode and/or anode via an intermediate component or layer (e.g., a Ni-based component), or they may be used in some other application.

It is also possible, although certainly not necessary, for the electrode material to further include a grain stabilizer, such as yttrium (Y), niobium (Nb), tantalum (Ta), and hafnium (Hf). The "grain stabilizer," as used herein, broadly includes any constituent that minimizes the grain size of one or more grains in the electrode material. Individual grains in an alloy have a natural tendency to assume larger sizes in order to reduce the overall surface area of high-energy grain boundaries, especially at elevated temperatures. A grain stabilizer can inhibit smaller grains from combining into larger grains by its presence at grain boundaries, which can limit motion of the grains at the boundaries. In one embodiment, a grain stabilizer constitutes the third greatest constituent in the electrode material and is present in an amount greater than or equal to 0.5 wt % and less than or equal to 5 wt %. In some preferred embodiments, the total grain stabilizer content is less than or equal to 2 wt %. Examples of suitable electrode material compositions that fall within this exemplary embodiment include W—Rh—Pt—Y alloys, such as 90W5Rh4Pt1Y. One of the two precious metals can be omitted to form a W—Rh—Y or W—Pt—Y alloy, for example.

The electrode material can be made using known powder metal processes that include choosing powder sizes for each of the metals, blending the powders to form a powder mixture, compressing the powder mixture under high isostatic pressure and/or high temperature to a desired shape, and sintering the compressed powder to form the electrode material. This process can be used to form the material into shapes (such as rods, wires, sheets, etc.) suitable for further spark plug electrode and/or firing tip manufacturing processes. Other known techniques such as melting and blending the desired amounts of each constituent can also be used. Due to the relatively low precious metal content, the electrode material can be further processed using conventional cutting and grinding techniques that are sometimes difficult to use with other known erosion-resistant electrode materials.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that that the listing is not to be considered as excluding other, additional components or items. Other terms are to be construed using their broadest reasonable meaning unless they are used in a context that requires a different interpretation.

The invention claimed is:

1. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material having a refractory metal and a precious metal, wherein the refractory metal is the single largest constituent of the electrode material on a wt % basis, the precious metal is the second largest constituent of the electrode material on a wt % basis, and the precious metal is present in the electrode material from about 1 wt % to about 50 wt %.

2. The spark plug of claim 1, wherein the refractory metal is present in the electrode material from about 50 wt % to about 99 wt %, inclusive.

3. The spark plug of claim 1, wherein the refractory metal includes at least one element selected from the group consisting of: tungsten (W), molybdenum (Mo), rhenium (Re), ruthenium (Ru) or chromium (Cr).

4. The spark plug of claim 1, wherein the precious metal includes at least one element selected from the group consisting of: rhodium (Rh), platinum (Pt), palladium (Pd) or iridium (Ir).

5. The spark plug of claim 1, wherein the electrode material includes a refractory metal, a first precious metal and a second precious metal.

6. The spark plug of claim 1, wherein the center electrode, the ground electrode or both includes an attached firing tip that is at least partially made from the electrode material.

7. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material having a refractory metal and a precious metal, wherein the refractory metal is the single largest constituent of the electrode material on a wt % basis, and the electrode material includes a protective surface layer where the refractory metal has volatized or evaporated and the precious metal has formed a stable oxide.

8. The spark plug of claim 7, wherein the protective surface layer has a thickness of about 1 to 12 microns (μm) and includes rhodium oxide ($Rh_2O_3$).

9. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material having a refractory metal and a precious metal, wherein the refractory metal is the single largest constituent of the electrode material on a wt % basis, and the electrode material includes tungsten (W) from about 50 wt % to about 99 wt %, inclusive, and rhodium (Rh) from about 1 wt % to about 50 wt %.

10. The spark plug of claim 9, wherein the electrode material includes tungsten (W), rhodium (Rh), and at least one other precious metal selected from the group consisting of platinum (Pt), palladium (Pd) or iridium (Ir).

11. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material having a refractory metal and a precious metal, wherein the refractory metal is the single largest constituent of the electrode material on a wt % basis, and the electrode material includes ruthenium (Ru) from about 50 wt % to about 99 wt %, inclusive, and rhodium (Rh) from about 1 wt % to about 50 wt %.

12. The spark plug of claim 11, wherein the electrode material includes ruthenium (Ru), rhodium (Rh), and at least one other precious metal selected from the group consisting of platinum (Pt), palladium (Pd) or iridium (Ir).

13. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an electrode material having a refractory metal and a precious metal, wherein the refractory metal is the single largest constituent of the electrode material on a wt % basis, and the electrode material further includes at least one grain stabilizer selected from the group consisting of: yttrium (Y), niobium (Nb), tantalum (Ta) or hafnium (Hf).

14. The spark plug of claim 13, wherein the grain stabilizer is present in the electrode material from about 0.5 wt % to about 5 wt %, inclusive.

15. A spark plug, comprising:

a metallic shell having an axial bore;

an insulator having an axial bore and being at least partially disposed within the axial bore of the metallic shell;

a center electrode being at least partially disposed within the axial bore of the insulator; and a ground electrode being attached to a free end of the metallic shell;

the center electrode, the ground electrode or both includes an attached firing tip that is at least partially made from an electrode material having a refractory metal and a precious metal, wherein the refractory metal is the single largest constituent of the electrode material on a wt % basis, and the firing tip is a multi-piece rivet that includes a second component attached to the center electrode or the ground electrode, and a first component that is attached to the second component and is at least partially made from the electrode material.

16. The spark plug of claim 1, wherein the center electrode, the ground electrode or both is at least partially made from the electrode material and does not include an attached firing tip.

17. A spark plug electrode, comprising:

an electrode material having a refractory metal and a precious metal, wherein the refractory metal is ruthenium (Ru) and has a melting temperature that is greater than that of the precious metal, the refractory metal is the single largest constituent of the electrode material on a wt % basis, and the precious metal is selected from the group consisting of: rhodium (Rh), platinum (Pt), palladium (Pd), or iridium (Ir).

18. A spark plug electrode, comprising:

an electrode material having tungsten (W), rhodium (Rh) and at least one other constituent, wherein tungsten (W) is the single largest constituent of the electrode material.

* * * * *